US006990787B2

(12) United States Patent
Rasmussen et al.

(10) Patent No.: US 6,990,787 B2
(45) Date of Patent: Jan. 31, 2006

(54) METHOD AND APPARATUS FOR PACKING OF ITEMS

(75) Inventors: Johannes Rasmussen, Horsens (DK); Henrik Ahrenfeldt, Horsens (DK)

(73) Assignee: Schur Packaging Systems A/S, Horsens (DK)

( * ) Notice: Subject to any disclaimer, the term of this patent is extended or adjusted under 35 U.S.C. 154(b) by 0 days.

(21) Appl. No.: 10/492,016

(22) PCT Filed: Oct. 7, 2002

(86) PCT No.: PCT/DK02/00671

§ 371 (c)(1),
(2), (4) Date: Jun. 9, 2004

(87) PCT Pub. No.: WO03/031268

PCT Pub. Date: Apr. 17, 2003

(65) Prior Publication Data

US 2004/0261372 A1 Dec. 30, 2004

(30) Foreign Application Priority Data

Oct. 8, 2001 (DK) ..... PA 2001 01481

(51) Int. Cl.
*B65B 43/26* (2006.01)

(52) U.S. Cl. ..... 53/459; 53/457; 53/381.2; 53/384.1

(58) Field of Classification Search ..... 53/284.7, 53/381.2, 384.1, 457, 459
See application file for complete search history.

(56) References Cited

U.S. PATENT DOCUMENTS

| | | | | | |
|---|---|---|---|---|---|
| 3,269,524 | A | | 8/1966 | Canfield | |
| 3,559,338 | A | | 2/1971 | Klingberg | |
| 3,618,286 | A | * | 11/1971 | Membrino | 53/459 |
| 3,751,875 | A | | 8/1973 | Membrino | |
| 3,779,449 | A | | 12/1973 | Membrino | |
| 4,179,867 | A | * | 12/1979 | Bodolay | 53/568 |
| 4,665,552 | A | * | 5/1987 | Lems et al. | 383/37 |
| 4,774,797 | A | * | 10/1988 | Colamussi et al. | 53/459 |
| 4,798,041 | A | | 1/1989 | Bentsen | |
| 4,863,285 | A | | 9/1989 | Claxton | |

(Continued)

FOREIGN PATENT DOCUMENTS

| | | |
|---|---|---|
| DE | 29 06 301 | 8/1980 |
| DE | 1998 00548 | 4/1998 |
| EP | 0 825 116 | 2/1998 |

(Continued)

*Primary Examiner*—Louis K. Huynh
*Assistant Examiner*—Thanh Truong
(74) *Attorney, Agent, or Firm*—James Creighton Wray; Meera P. Narasimhan

(57) ABSTRACT

Methods are known for conveying bags in the form of a continuous web such that they open at a suitable place during continuous conveyance and during maintenance of the open condition so they can be filled and sealed after closing. Prior art methods utilize complicated methods for retention. According to the invention, the bag web is suspended on horizontal studs mounted on carrier chains running in such a way that the bags open and a surrounding groove around the studs along the chains prevents the bags from falling off during passage of filling stations etc.

2 Claims, 1 Drawing Sheet

U.S. PATENT DOCUMENTS 5,673,541 A 10/1997 Arzuman et al.
5,687,549 A 11/1997 Jostler et al.
5,733,045 A * 3/1998 Jostler et al. ..... 383/37
5,944,424 A * 8/1999 Lerner et al. ..... 383/37
6,591,586 B1 * 7/2003 Pape ..... 53/459
6,625,956 B1 * 9/2003 Soudan ..... 53/455

FOREIGN PATENT DOCUMENTS

EP 0 396 838 11/1998
WO WO 99/57017 4/1998

* cited by examiner

METHOD AND APPARATUS FOR PACKING OF ITEMS

This application claims the benefit of Danish Application No. PA 2001 01481 filed Oct. 8, 2002 and PCT/DK02/00671 filed Oct. 7, 2002.

BACKGROUND OF THE INVENTION

Method for packing items or loose material in suspended film bags.

The present invention relates to a method and an apparatus for packing items in film bags which are conveyed through a filling station in a continuous web where a filling of the individual bag items is performed, which bags are then closed and separated from the continuous web for establishment of individual packings.

A basic example of this technology is mentioned in EP-696997 in which it is stated that the opposite upper edge areas of the bag item web is made with bent rim parts formed by grooves for drawing in on conveyance bars which have a mutual expansion for producing an opening of the bag items in the direction of conveyance, such that these can be filled, for example through a superjacent funnel, where after the conveyance bars are narrowed against each other again for temporary closing of the filled bag items. These can then be closed completely by welding below said groove parts where after these are cut off and the items mutually separated. As an alternative it is stated that instead of groove parts, edge thickenings may be applied which may be received in slotted conveyance pipes for a quite corresponding conveyance of the bag items.

Since then other types of means have been suggested for catching and carrying the opposite upper edges of the bag item web, for example as stated in EP 0 555 321 B where special catching chains are used for the purpose without special requirements to the design of the upper edge areas of the folded bag item web. This is of substantial significance in that as an end product a simple rolled op flat film web without local thicknesses may be used, however in return there are considerable problems with regard to both the guidance of the opposite edges of the bag items for a safe engagement with the chains and with regard to a desirably inexpensive embodiment of these chains.

In EP 0 396 838 and EP 0 825 116 it is furthermore stated that a flat pipe web of the film can be applied which can continuously be cut open along its upper edge with integrated unfolding and catching of the thus cut open upper edges without these being specifically designed neither as grooves nor with thickenings which will indicate a distinct simplification of the requirements for the production of the bag web. The cut open upper edge parts are unfolded to be squeezed between respective moving belts made with longitudinal recesses and corresponding pressing cords whereby a suitably firm carrier engagement can be established.

However, this engagement is not firmer than axial slidings may occur between the upper edges of the bag web and the associated means for belt transport whereby uncertainty may arise as to whether a conveyed item has been conveyed completely synchronously with the conveyor belts. Moreover, deviations may arise with regard to height location of the area of the web sides that is squeezed between the conveyor belts which may be of importance as to whether the filled bags are completely closed at the location intended for this exact purpose, for example in relation to print on the bag.

In DK PA 1998 00548 is described a construction which uses a simplified flat bag web as said opening edge is merely closed when the web is introduced on a single carrier bar and is continuously cut open in a station where the thereby upright rim strip parts are unfolded in order to be laid down on opposite chains. In advance, these strip parts are made with a row of holes which are led down into upwards directed holding studs on the carrier chains during folding down whereby a safe carrier and propelling engagement is achieved without any special profiling of the opening edges.

SUMMARY OF THE INVENTION

During use of the last described construction it has turned out that it is true that it comprises the advantages described, however they can be obtained in a simpler way. It is the object of the invention to provide a method for packing items or loose material in film bags which in a continuous web are conveyed through a filling station which is simplified in relation to prior art constructions and which allows for a higher speed through a plant performing the method.

It is achieved with a method which is peculiar in that during conveyance on a smooth guide rail, the bag web is introduced between a left and a right chain which at a distance identical with the distance between the holes in the bag web carries horizontal studs which from each side are introduced into the holes designed in the bag web whereby longitudinal groove surrounding the end of the horizontal studs secure the studs' retention of the bag web.

An apparatus for performing the method is peculiar in that the guide rail changes into a broader mandrel-shaped rail part designed with first longitudinal grooves at each side, which rail part changes into a wedge-shaped body with second longitudinal grooves in continuation of the first longitudinal grooves which wedge-shaped body changes into two parallel third longitudinal grooves whereby two endless chains with horizontal studs having a distance corresponding to the distance between the holes in the bag web are maintained against the longitudinal grooves by rails and guide rolls such that the studs end up everywhere inside the longitudinal grooves as the two chains move in parallel with the studs opposite each other and as the distance between the third longitudinal grooves corresponds to the distance needed for obtaining a desired opening of the bags.

DESCRIPTION OF THE DRAWING

In the following, the invention will be described in more detail with reference to the drawing where

BRIEF DESCRIPTION OF THE DRAWINGS

Figure 1:
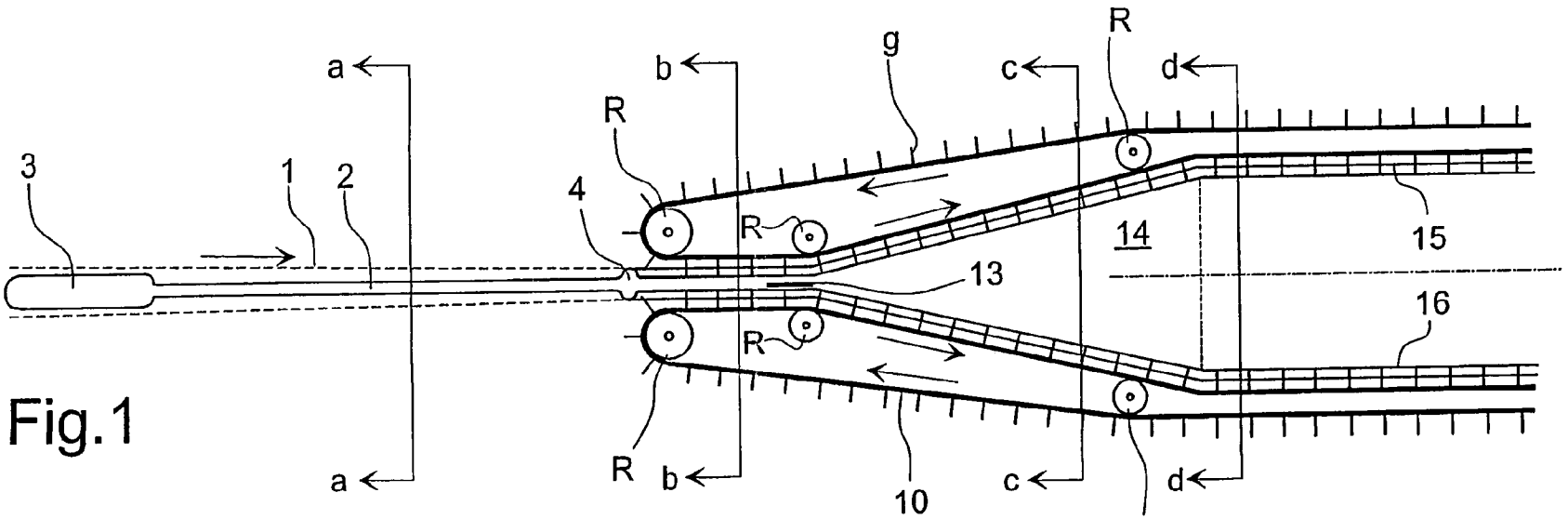
Figure 2:
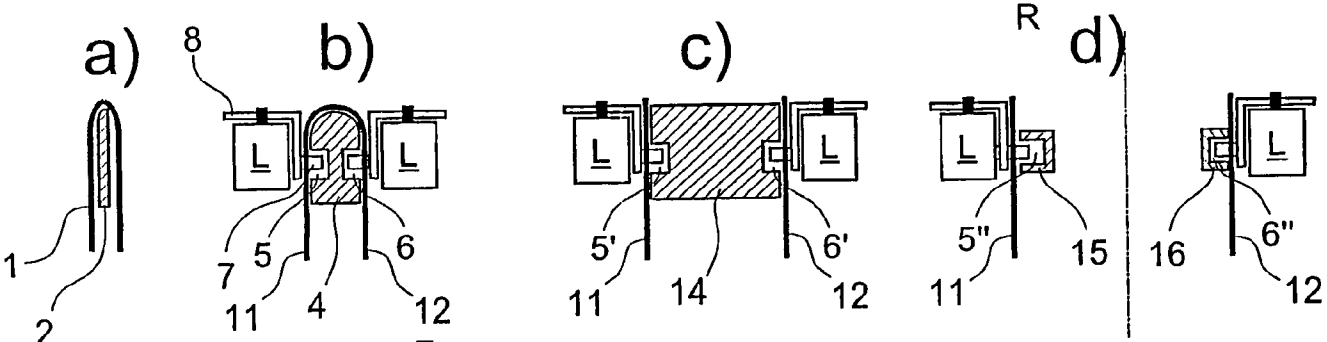
Figure 3:
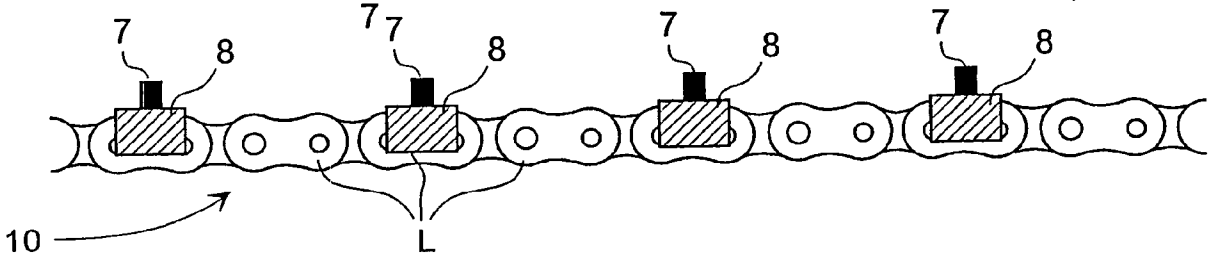

FIG. 1 shows the essential components in an apparatus performing the method, FIGS. 2*a–d* show a number of cross-sections of the introduction of the bag web, and FIG. 3 shows links in the chain with fittings and studs.

DETAILED DESCRIPTION OF THE PREFERRED EMBODIMENTS

From a not shown depot, a bag web 1 of synthetic material is conveyed in the direction of the arrow on a smooth rail 2 (cross-section 2*a*) which has a rounded part 3 facing the direction of the conveyance of bags. The bag web hangs in the upper part of the plastic film which is designed for this purpose, and it is provided with customary incisions and weakened spots which are not shown. Moreover, the upper part is provided with a number of perforations for indications of holes having a fixed mutual distance. The rail changes into a thicker mandrel 4 (cross-section 2*b*) with a groove 5, 6 designed at each side. The grooves have a width and a depth corresponding to studs 7 which by means of fittings 8 with a fixed distance are arranged on two endless chains 9, 10. The studs move synchronously with the bag web 1 in such a way that the studs from each side penetrate a layer 11, 12 in left and right side, respectively, of the upper part of the bag web. The plastic film is distended by the mandrel 4 and the studs, and it passes a vertical knife 13 at the upper side of the mandrel, after which the two now separate parts 11 and 12 of the bag web are eventually carried by the chains provided with studs. Due to the grooves 5, 6 designed surrounding the end of the studs 7, the plastic film cannot slide beyond the ends of the studs.

The mandrel changes into a wedge-shaped block 14 (cross-section 2*c*) which is correspondingly provided with longitudinal grooves 5', 6', and during the further transport of the bag web 11, 12, the bags are gradually opened. When achieving maximum opening, the block 14 changes into longitudinal rails 15, 16 (cross-section 2*b*) still with longitudinal grooves 5", 6", and these rails convey the bag web forward below and between regular stations for filling, sealing, cutting free etc. All the time, the chains 9, 10 with the studs 7 take care of the transport, and the guiding of the chain by means of various rolls R, and rails take care of the studs remaining in the grooves 5, 5', 5", 6, 6', 6" such that the plastic film cannot slide off. In a suitable place, a driving gear wheel is placed for each chain. At the end of the packing plant (not shown) the studs are pulled apart as the chains run about a guide roll, and the bags cut free can be gripped at this place and transported away or fall onto a conveyor belt. It is noted that where FIG. 1 in merely schematic such that certain dimensions are exaggerated due to clarity, then FIG. 2 at least with regard to the proportions between the incoming elements corresponds to a practical construction.

One of the chains (10) is shown in. FIG. 3 where every other link L is provided with fittings 8 carrying a projecting stud in the plan of the chain.

This improved effect compared with prior art is among others ascribed to the fact that according to the present invention, the studs 7 are shorter, and that gravity is not necessary in order to ensure that the plastic film 11, 12 remains on the studs during transport.

What is claimed is:

1. Method for packing items of lose material goods in film bags comprising the steps of:

conveying interconnected bags having opening edges in a continuous web through a filling station;

bringing the bag web along its opening edges into controlled connection with guide means, wherein said guide means include a smooth guide rail, a left chain and a right chain, said smooth guide rail includes longitudinal grooves, said chains are provided with studs placed spaced apart at equal distances on said chain, said studs horizontally project from the chains and horizontally arranged in a plan of the chains that is substantially perpendicular to said bag web, said bag web includes holes spaced apart at equal distances along the bag web opening edges, and wherein the distance between said studs and the distance between said holes are identical;

forcing the opening edges of the bags apart for successively opening of the bags at the filling station as the bag web is in connection with said guide means by engaging said studs through the holes in the opening edges of the bag web against the longitudinal grooves to retain and guide forward opposite opening edges of the bags along the longitudinal grooves of the smooth guide rail through the filling station;

filling the opened bags with said items or loose material goods at the filling station; then connecting the opening edges of the bags for closing the bags; and separating the bags from the web.

2. Apparatus for packing items or loose material goods in film web of continuous film bags comprising:

a conveyor for conveying interconnected bags in a continuous web, said bag web comprising holes spaced at equal distances along opening edges;

a filling station where the bags are kept open for reception of items or loose material goods; and guide means including a smooth guide rail, a left chain and a right chain;

wherein the guide rail changes into a broader, mandrel-shaped rail part designed with first longitudinal grooves at each side, said rail part changes into a wedge-shaped body with second longitudinal grooves in continuation of the first longitudinal grooves, and said wedge-shaped body changes into two parallel third longitudinal grooves;

wherein said chains are provided with horizontal studs placed at equal distances which are identical with said equal distances between the holes in the bag web opening edges, said studs projecting horizontally in a plan of the chains that is substantially perpendicular to said bag web; and wherein said studs are held against the longitudinal grooves by rails and guide rolls such that the ends of the studs are inside the longitudinal grooves, as the two chains move in parallel with the studs opposite each other, and as the distance between the third longitudinal grooves corresponds to the distance needed for obtaining a desired opening of the bags.

* * * * *

UNITED STATES PATENT AND TRADEMARK OFFICE

CERTIFICATE OF CORRECTION

PATENT NO. : 6,990,787 B2
DATED : January 31, 2006
INVENTOR(S) : Rasmussen et al.

It is certified that error appears in the above-identified patent and that said Letters Patent is hereby corrected as shown below:

Column 1,
Line 5, change "Oct. 8, 2002" to -- Oct. 8, 2001 --.

Signed and Sealed this

Ninth Day of May, 2006

JON W. DUDAS
*Director of the United States Patent and Trademark Office*